US007101249B2

(12) United States Patent
Forti et al.

(10) Patent No.: US 7,101,249 B2
(45) Date of Patent: Sep. 5, 2006

(54) WIGGLE FLYER

(75) Inventors: William M. Forti, Claremont, CA (US); William B. Forti, Claremont, CA (US); David M. Turchik, Corona, CA (US)

(73) Assignee: William Mark Corporation, Claremont, CA (US)

( * ) Notice: Subject to any disclaimer, the term of this patent is extended or adjusted under 35 U.S.C. 154(b) by 131 days.

(21) Appl. No.: 10/840,032

(22) Filed: May 5, 2004

(65) Prior Publication Data

US 2005/0250410 A1 Nov. 10, 2005

(51) Int. Cl.
*A63H 1/06* (2006.01)

(52) U.S. Cl. ..... 446/247; 446/34; 446/486; 473/575

(58) Field of Classification Search ..... 446/34, 446/68, 230, 247, 486, 236; 473/575, 576; 244/155 R, 155 A
See application file for complete search history.

(56) References Cited

U.S. PATENT DOCUMENTS

| | | | | |
|---|---|---|---|---|
| 162,141 | A * | 4/1875 | Bayles | 273/450 |
| 3,428,321 | A | 2/1969 | Manning | |
| 3,703,292 | A * | 11/1972 | Starr | 273/330 |
| 4,294,447 | A | 10/1981 | Clark | |
| 4,624,648 | A | 11/1986 | Waters | |
| 4,685,642 | A | 8/1987 | Schloss | |
| 4,696,472 | A | 9/1987 | Meyer | |
| 5,120,263 | A * | 6/1992 | Ierfino et al. | 446/486 |
| RE34,032 | E | 8/1992 | Callaghan | |
| 5,431,591 | A * | 7/1995 | Muzzi | 446/397 |
| 5,634,643 | A | 6/1997 | McEvoy | |
| 5,660,576 | A | 8/1997 | Winga | |
| 5,727,984 | A * | 3/1998 | Lin | 446/431 |
| 5,813,931 | A | 9/1998 | Gormley | |
| 6,099,381 | A * | 8/2000 | Sodeshima | 446/487 |
| 6,120,398 | A | 9/2000 | Myers | |
| 6,361,395 | B1 * | 3/2002 | Pacza | 446/368 |
| 6,461,220 | B1 * | 10/2002 | Ming | 446/486 |
| 6,468,126 | B1 * | 10/2002 | Herber | 446/310 |
| 6,554,684 | B1 | 4/2003 | Marlin | |
| 2002/0197933 | A1 | 12/2002 | Shea | |

* cited by examiner

*Primary Examiner*—Bena Miller
(74) *Attorney, Agent, or Firm*—Rutan & Tucker, LLP

(57) ABSTRACT

A flying toy has a spiral-shaped tail to which a head portion is coupled to effect a wiggling flight pattern of the toy. In preferred embodiments, the spiral-shaped tail is fabricated from a material that maintains the spiral shape of the tail during flight, and has a configuration effective to impart a wiggling motion of the tail.

16 Claims, 1 Drawing Sheet

WIGGLE FLYER

FIELD OF THE INVENTION

The field of the invention is flying toys.

BACKGROUND OF THE INVENTION

Numerous flying toys with various attachments or streamers are known in the art. For example, single streamers attached to balls and other aerial toys are known from U.S. Pat. No. 5,660,576 to Winga or U.S. Pat. No. 4,696,472 to Meyer. In other examples (see U.S. Pat. No. 4,294,447 to Clark or U.S. Pat. No. 5,813,931 to Gormley), the inventors teach aerial toys with multiple streamers. Streamers may also have the shape of a sock as described in U.S. Pat. No. 5,634,643 to McEvoy or U.S. Pat. No. Re34,032 to Callaghan. Alternatively, a streamer may be rotatably attached to a kite as described in U.S. Pat. No. 4,624,648 to Waters, or the entire kite may be a rotating aerial object as taught by Schloss in U.S. Pat. No. 4,685,642. While streamers on balls and other aerial toys are often thought to be more attractive and inviting than toys without such appendages, the time flight of the toy is typically reduced due to the increase in drag.

In other known toys, a screw-shaped tail is part of a football as described in U.S. Pat. No. 6,120,398 to Myers. In such a toy, rotational momentum is provided to the football that spins along the central axis of the spiral-like tail. Similarly, as taught by Manning in U.S. Pat. No. 3,428,321, a fur fletched arrow has a fur wound along the shaft in a screw-like manner to rotationally stabilize flight of the arrow. The flight stability and even time of such aerial toys is typically increased, however, such toys often require substantial effort or velocity to achieve a spinning motion.

Further known toys with a coil are known from U.S. Pat. No. 5,727,984 to Lin in which a ball is rotatably attached to a coiled spring that is covered by a cloth to simulate a snake. When the ball is rolled on the ground, Lin describes the action of the coil as chasing after the ball while the ball is rolling. Similarly, as described in published U.S. App. No. 2002/0197933, a rolling coil is presented by Shea. As Shea's toy is intended for a cat, the size of the coil is limited to about 2 inches with a weight of less than 2 ounces to at least retain some functionality. Finally, an elastic coiled lasso is described in U.S. Pat. No. 6,554,684 to Marlin, wherein the lasso is held on one end by a user while the other end uncoils and wraps around a target before wrapping around itself. Therefore, while Lin, Shea, and Marlin include a coil in their toys, none of those toys is used or even fit for use as a flying toy.

Therefore, while numerous toys are known in the art, all or almost all of them suffer from one or more disadvantages. Consequently, there is still a need for improved toys, and especially flying toys.

SUMMARY OF THE INVENTION

The present invention is directed to flying toys that are preferably manually propelled by a user, and in which the toy includes a head portion that is coupled to a spiral-shaped tail that imparts a wiggling motion to the spiral-shaped tail and/or head portion during flight.

In one aspect of the inventive subject matter, the head portion is fixedly coupled to the spiral-shaped tail, wherein the tail comprises a material that maintains the spiral shape of the tail during flight, and wherein the spiral-shaped tail has a configuration (e.g., length, number of full turns, etc.) effective to impart a wiggling motion to the head and/or spiral-shaped tail. In some of the preferred aspects, the spiral-shaped tail has a configuration other than a screw and curves around the longitudinal axis to a degree effective to impart rotation of the tail about the longitudinal axis during flight, while in other aspects the wiggling motion includes a motion of the head that is non-linear relative to the path of flight.

Especially contemplated head portions include elastic balls, magnets, hook-and-loop fasteners, liquid retainers, and/or a sound producing portion, all of which may further be coupled to an engaging element that engages with a launcher. With respect to the tail, it is generally preferred that the tail has a coil shape other than a screw, which may be evenly angled or stepped. Regardless of the particular configuration of the coil, it is contemplated that at least a portion of the tail may act as an air foil. Suitable materials used for the tail therefore include preformed synthetic polymer and a metal wire, preferably embedded in a soft material. In particularly preferred toys, the weight ratio between the head portion and the spiral-shaped tail is typically is between 20:1 and 1:1.

In another aspect of the inventive subject matter, a game kit includes a flying toy in which a head portion is fixedly coupled to a spiral-shaped tail. The spiral-shaped tail in such toys preferably comprises a material that maintains the spiral shape of the tail during flight, wherein the spiral-shaped tail has a configuration other than a screw that is effective to impart a wiggling motion to the head and/or tail portion as described above. Preferred kits will preferably include an instruction to a user to propel the flying toy into the air. With respect to the head portion and the tail, the same considerations as provided above apply.

Various objects, features, aspects and advantages of the present invention will become more apparent from the accompanying drawing, and the detailed description of preferred embodiments of the invention.

DETAILED DESCRIPTION

Figure 1:
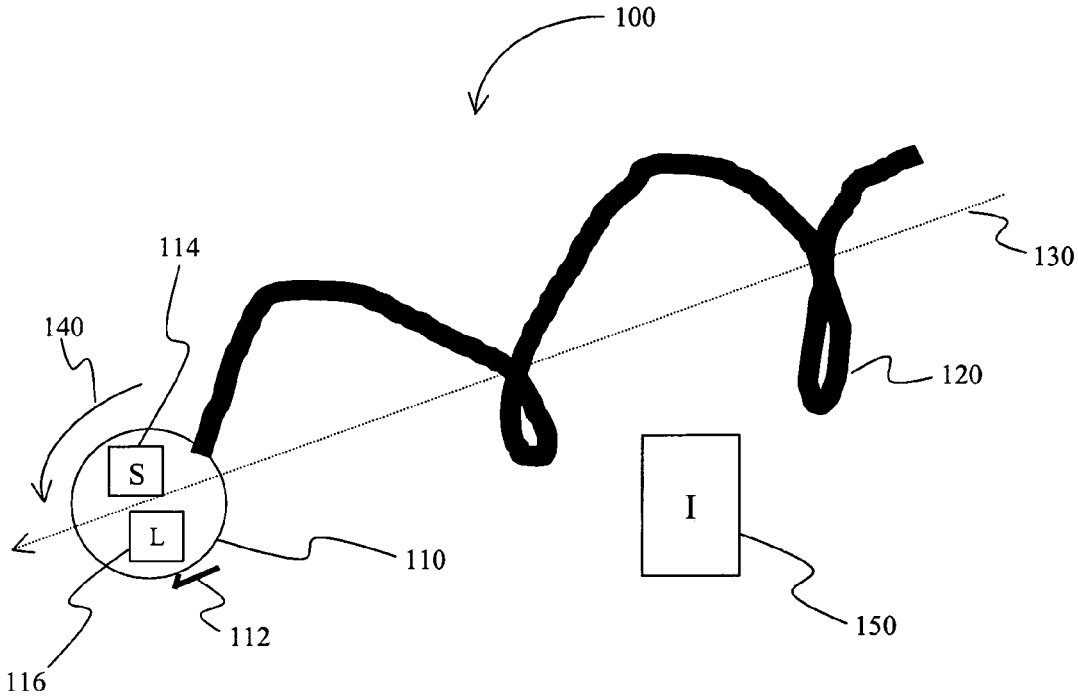
FIG. 1 is a perspective schematic illustration of one exemplary flying toy according to the inventive subject matter.

The inventors have discovered that a flying toy can be produced in which a spiral-shaped tail is coupled to a head portion, and that such toys will fly in an entertaining manner for players as well as onlookers. In one particularly preferred aspect, it is contemplated that the flying toy has a head portion that is fixedly coupled to a spiral-shaped tail. The spiral-shaped tail preferably comprises a material that maintains the spiral shape of the tail during flight, and has a shape other than a screw. In especially preferred configurations, the tail curves around its longitudinal axis to a degree effective to impart rotation of the tail during flight. Such rotation may further impart a motion to the head portion that is non-linear relative to the path of flight. It should be recognized that the inventors specifically contemplate flying toys that are thrown by a human along a flight path, and expressly exclude toys of which at least one portion will remain held by a user (see e.g., lasso toy as described in U.S. Pat. No. 6,554,684).

The term "head portion" as used herein refers to an element that is coupled to a terminal portion of the tail (i.e., at a distance from the end of the tail no more than 25% of the entire tail length), and that is distinct in structure and/or function from the structure and/or function of the tail. For example, an elastic ball (e.g., racquet, tennis, or squash ball) glued or otherwise coupled to one end of the tail would be considered a head portion as the ball has a structure that is different from the tail. Similarly, a piece of a hook-and-loop fastener integrated into one end of the tail would be considered a head portion as the hook-and-loop fastener has a function (here: temporarily fastening) that is distinct from the tail (e.g., non-fastening, among other functions). In contrast, a terminal portion of a coil is not considered a head portion under the scope of this definition as both the structure and/or function of the head portion are indistinguishable from the remaining tail. Therefore, a rolling coil as described in published U.S. App. No. 2002/0197933 will not fall under the scope of this definition as there is no distinguishable head portion.

As also used herein, the term "fixedly coupled" refers to a mode of coupling in which a momentum of the tail during flight is transferred to the head portion. Therefore, the term "fixedly coupled" especially includes coupling in which a portion of the tail is inserted into the head portion, or in which the head portion is coupled to the tail via a connector element that is less easily deformed (as determined by using manual force) than the head and/or tail. The term "configuration other than a screw" as used herein means that at least part of the material that forms the winding portion of the spiral-shaped (and more typically at least one, two, or more windings of the coil) will not coincide with the longitudinal axis of the tail or an element that coincides with the longitudinal axis of the tail. Furthermore, the terms "force the head portion into a non-linear path relative to the flight path" and "impart a motion to the head portion that is non-linear relative to the path of flight" are used interchangeably herein and mean that the head portion will exhibit a motion that has a component that is perpendicular to the flight path (i.e., a hypothetical parabolic or hyperbolic line between the users). For example, in at least some instances, the head portion of contemplated toys will move along a spiral-shaped path along the flight path, wherein the spiral-shaped path may be somewhat irregular due to external influences (e.g., wind) or other factors (e.g., how the toy is thrown). In other instances, and especially where the head portion is relatively heavy as compared to the tail portion, the wiggling motion of the head may not be readily apparent, while the rotating and wiggling motion of the tail is readily apparent. In contrast, it should be appreciated that the screw-shaped tailfin of a football as described in U.S. Pat. No. 6,120,398 will neither wiggle, nor force the head portion into a non-linear path relative to the flight path. Rather, the tail fin will spin the head portion along the flight path to produce a stabilized flight. Still further, screw-shaped tail fins as described in the '398 patent are expressly excluded herein from contemplated tail configurations (supra).

As still further used herein, the term "spiral-shape" refers to a shape that can be defined as a plane curve that is traced by a point circling about the center but at ever-greater distances from the point, wherein the radius of the curve may change, and wherein the increase in distance may change as well. However, while numerous variations of a spiral may are contemplated (including spirals with less than one complete turn), screw-shaped configurations are expressly excluded herein. Finally, as also used herein, the term "maintains the spiral shape of the tail during flight" means that the spiral shape of the tail during at least 50% of the flight will substantially be the same (i.e., change in length less than 15%) as the shape of the tail when the toy is not in motion. Viewed from another perspective, the spiral-shaped tail of toys under the scope of this definition will substantially be the same (i.e., change in length less than 15%) when the head portion is moved along a resting horizontal a surface as compared to the shape of the tail when the toy is not in motion. In contrast, a toy as described in U.S. Pat. No. 5,727,984 will not fall under the scope of this definition as the tail will chase (i.e., significantly retract after extension) after the head portion in use.

Figure 2:
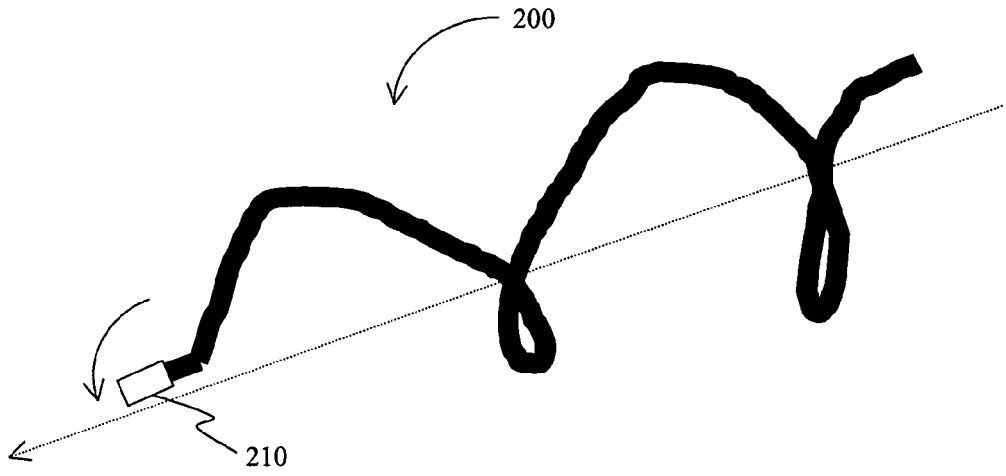
FIG. 2 is a perspective schematic illustration of another exemplary flying toy according to the inventive subject matter.

In one preferred aspect of the inventive subject matter, as depicted in FIG. 1, a toy 100 has a racquet ball as a head portion 110, and a spiral-shaped polyurethane foam tail 120 that is partially inserted into the head portion 110. The spiral-shaped tail 120 has two turns, and a length of about 20 inches. The flight path 130 is depicted in a broken line. The movement of the head portion 110 and tail portion 120 is indicated by directional arrow 140 illustrating a forward spiraling movement of the head and tail portions along the flight path 130. Optionally, head portion 110 may further include a hook or other retainer 112 that allows launch from a manually operated launcher (e.g., slingshot, not shown). In alternative exemplary embodiments as depicted in FIG. 2, the head portion 210 of flying toy 200 includes a hook-and-loop type fastener. Such toys are particularly contemplated where target (e.g., glove, figurine, bulls eye target, etc.) with corresponding hook-and-loop fasteners is used.

In further aspects of the inventive subject matter, the head portion need not be limited to a racquet ball, and numerous alternative head portions are considered suitable for use herein. For example, contemplated head portions include balls other than a racquet ball, and particularly preferred balls are those that are elastic (i.e., manually deformable using reasonable force (e.g., squash balls, tennis balls, etc)). Further contemplated head portions include one or more magnets, at least a portion of a hook-and-loop fastener, a liquid retainer, (L, 114 in FIG. 1), a sound producer, (S, 116 in FIG. 1), etc. Thus, suitable head portions may also be characterized by their function and/or appearance, and particularly contemplated functions include various signal producing functions (e.g., optical or acoustical signal), retaining functions (e.g., magnetic, hook-and-loop, low-tack glue, etc.), and transporting functions (e.g., optionally colored fluid, parachute, etc.). Especially contemplated appearances include depictions or models of airplanes, rockets, and other flying objects (identified and otherwise), pilots, or any object commonly found in daily life. Of course, it should be recognized that the appearances listed above may be combined with contemplated functions. In still further preferred aspects of the inventive subject matter, it should be recognized that the center of gravity of the head portion, and even more preferably the entire head portion, may be in a position that does not coincide with the axis of the spiral (i.e., the imaginary line centered in the spiral and longitudinally extending therethrough) of the spiral shaped tail to achieve a wiggling motion of the head, while the center of gravity of the head portion may also be in line with the axis of the spiral to reduce a wiggling motion of the head while providing wiggling of the tail.

Moreover, it is contemplated that the head portion may also include an engaging element that engages with a launcher to propel the flying toy into the air. Suitable engaging elements include all those that transfer a force from the launcher to the toy, and therefore include hooks, catches, indentations, all of which may have additional elements to retain and/or guide the toy in a desired position relative to the launcher. Consequently, launchers will include those in which compressed air, momentum of a launch actuator, and/or spring tension will propel the toy into the air.

With respect to the spiral-shaped tail, it should be recognized that the shape, number of turns, and length of the tail may vary considerably. In most instances, contemplated tails have a length of between 4 inches and 40 inches, and most typically between 8 inches and 25 inches. Preferably, contemplated tails will have at least two, and more typically at least 4 turns, wherein the spiral shape may be a coil having an evenly angled spiral or a stepped spiral. Where desirable, contemplated tails may include less than two turns, and in some aspects even less than one turn. In further contemplated aspects, it should also be recognized that the spiral-shaped tail may also include a non-spiral portion, which may be disposed at either or both ends. Alternatively, or additionally, a non-spiral portion may be coupled at either end to a spiral portion.

Suitable materials for the spiral-shaped tail may also vary considerably so long as they provide sufficient resilience to maintain the spiral shape of the tail during flight. Therefore, contemplated materials include various foamed or otherwise porous synthetic polymers (e.g., foamed polyurethane), solid synthetic polymers (e.g., low density polyethylene), natural polymers and products thereof (e.g., wood, paper, or cardboard), metals (e.g., aluminum), and all reasonable mixtures thereof. The spiral shape may be imparted in numerous manners, and all known manners of shaping polymers are deemed suitable for use herein. For example, a spiral shaped tail may be extruded, heat-shaped, or reinforced with a bendable or otherwise pre-shaped scaffold (e.g., metal wire). Moreover, it is contemplated that at least part of the tail may act as an airfoil. Therefore, a cross sectional profile of the tail may be shaped other than a round cross section, and especially preferred shapes include L-shaped profiles or (airplane)wing-like profiles.

While not limiting to the inventive subject matter, it is generally preferred that the weight ratio between the head portion and the spiral-shaped tail is between 20:1 and 1:10, and more typically in the range between 10:1 and 1:5. Viewed from another angle, the weight ratio is preferably chosen such that the ratio enables a wiggling flight of the toy, and especially a flight in which rotational movement of the tail forces a motion to the head portion that is non-linear relative to the path of flight.

Therefore a kit may include a flying toy that includes a head portion that is fixedly coupled to a spiral-shaped tail, wherein the spiral-shaped tail comprises a material that maintains a spiral shape of the tail during flight, and wherein the spiral-shaped tail has a configuration other than a screw that is effective to impart rotation of the tail about the longitudinal axis during flight, and an instruction (I, 150 in FIG. 1) to a user to propel (manually, or with a launcher) the flying toy into the air. With respect to the head portion and the spiral-shaped tail, the same considerations as provided above apply. It should be appreciated that instructions may be given in numerous manner, and especially contemplated manners include providing the instruction on the package, on a flyer associated with the toy, on the toy itself, or in a commercial advertisement (e.g., poster at sales event, audio, TV, Internet, etc.).

Thus, specific embodiments and applications of flying toys have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be inter-preted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A flying toy comprising:

a head pardon that is fixedly coupled to a spiral-shaped tail, wherein the spiral-shaped tail comprises a material having sufficient resiliency to maintain a spiral shape of the tail during flight when the toy is thrown into the air by a user;

wherein the material further has sufficient resiliency to maintain the shape of the spiral-shaped tail substantially the same when the head portion is moved along a resting horizontal surface as compared to the shape of the tail when the toy is not in motion;

wherein the spiral-shaped tail is configured to have a longitudinal axis and a shape other than a screw;

wherein the spiral-shaped tail is configured to curve around the longitudinal axis to a degree effective to impart rotation of the rail about the longitudinal axis during flight; and wherein the flying toy has a weight ratio of head portion to tail that is between 10:1 to 20:1.

2. The flying toy of claim 1 wherein the head portion comprises a portion selected from the group consisting of an elastic ball, a magnet, a hook-and-loop fastener, a liquid retainer, and a sound producer.

3. The flying toy of claim 1 wherein the head portion further comprises an engaging element that engages with a launcher.

4. The flying toy of claim 1 wherein the spiral-shaped rail has a coil shape.

5. The flying toy of claim 1 wherein the spiral-shaped tail comprises an evenly angled spiral or a stepped spiral.

6. The flying toy of claim 1 wherein the spiral-shaped tail is manufactured from a material selected from the group consisting of a foamed polymer, a porous polymer, a solid synthetic polymer, paper, and cardboard.

7. The flying toy of claim 6 wherein the spiral-shaped tail further comprises a metal wire.

8. The flying toy of claim 1 wherein the ratio is between 15:1 and 10:1.

9. A game kit comprising:

a flying toy that includes a head portion that is fixedly coupled to a spiral-shaped tail, wherein the spiral-shaped tail comprises a material that is effective to maintain a spiral shape of the tail during flight;

wherein the spiral-shaped tail has a longitudinal axis and a configuration other than a screw;

wherein the spiral-shaped tail is configured to curve around the longitudinal axis to a degree effective to impart rotation of the tail about the longitudinal axis during flight;

wherein the flying toy has a weight ratio of head portion to tail that is between 10:1 to 20:1;

wherein the head portion and the tail are coupled to each other such that a wiggling motion of the toy is enabled in which the tail rotates about the longitudinal axis; and an instruction to a user to propel the flying toy into the air to impart rotation of the tail about the longitudinal axis during flight.

10. The kit of claim 9 wherein the head portion comprises a portion selected from the group consisting of an elastic ball, a magnet, a hook-and-loop fastener, a liquid retainer, and a sound producer.

11. The kit of claim 9 wherein the head portion further comprises an engaging element that engages with a launcher.

12. The kit of claim 9 wherein the spiral-shaped tail has a coil shape and is manufactured from a material selected from the group consisting of a foamed polymer, a porous polymer, a solid synthetic polymer, paper, and cardboard.

13. The kit of claim 9 wherein the spiral-shaped tail comprises an evenly angled spiral or a stepped spiral.

14. The kit of claim 9 wherein the spiral-shaped tail comprises a portion that acts as an air foil.

15. The kit of claim 12 wherein the spiral-shaped tail further comprises a metal wire.

16. The kit of claim 1 wherein the instruction to propel comprises an instruction to hold the tail while whirling the toy in a rotational movement.

* * * * *